US006892424B1

(12) United States Patent
Habegger et al.

(10) Patent No.: US 6,892,424 B1
(45) Date of Patent: May 17, 2005

(54) SINGLE LINK HINGE ASSEMBLY WITH BREAK-AWAY LINK

(75) Inventors: Jeffrey D. Habegger, Wadsworth, OH (US); Steven O. Cummins, Mansfield, OH (US); Bruce M. Cummins, Mansfield, OH (US)

(73) Assignee: Mansfield Assemblies Co., Mansfield, OH (US)

( * ) Notice: Subject to any disclaimer, the term of this patent is extended or adjusted under 35 U.S.C. 154(b) by 35 days.

(21) Appl. No.: 10/637,141

(22) Filed: Aug. 8, 2003

(51) Int. Cl.[7] ..... E05F 1/08

(52) U.S. Cl. ..... 16/289; 16/343; 16/374; 16/297; 16/321; 126/194; 49/386

(58) Field of Search ..... 16/289, 297, 344, 16/306, 331, 362, 321, 343, 374; 126/190, 126/191, 192, 194; 49/386, 389

(56) References Cited

U.S. PATENT DOCUMENTS

| | | | | |
|---|---|---|---|---|
| 3,842,542 | A * | 10/1974 | White et al. | 49/386 |
| 4,001,973 | A * | 1/1977 | Rice et al. | 49/386 |
| 4,138,988 | A * | 2/1979 | Hurley | 126/194 |
| 4,287,873 | A * | 9/1981 | Goins et al. | 126/194 |
| 4,315,495 | A * | 2/1982 | Jellies | 126/194 |
| 4,665,892 | A * | 5/1987 | Spargo et al. | 126/194 |
| 5,291,634 | A | 3/1994 | Zanetti | |
| 5,341,542 | A | 8/1994 | Hannan et al. | |
| 5,822,925 | A * | 10/1998 | McKinney et al. | 49/386 |
| 6,397,836 | B1 * | 6/2002 | Pelletier et al. | 126/194 |
| 6,453,510 | B1 | 9/2002 | Cummins et al. | |
| 6,789,293 | B2 * | 9/2004 | Habegger et al. | 16/343 |
| 2003/0221285 | A1 * | 12/2003 | Habegger et al. | 16/297 |
| 2004/0172787 | A1 * | 9/2004 | Collene et al. | 16/289 |

FOREIGN PATENT DOCUMENTS

| | | | |
|---|---|---|---|
| CH | 622171 | A5 * | 3/1981 |
| DE | 3345999 | A1 * | 6/1985 |
| EP | 872692 | A1 * | 10/1998 |

* cited by examiner

*Primary Examiner*—Chuck Y. Mah
(74) *Attorney, Agent, or Firm*—Fay, Sharpe, Fagan, Minnich & McKee, LLP

(57) ABSTRACT

A hinge assembly for connecting an appliance door to an appliance frame includes a claw and a channel pivotally connected to the claw. A single link member is pivotally connected to the claw, and the link member defines first and second contact surfaces. The second contact surface defines an operative portion and a break-away portion separated from the operative portion by a peak. A spring is operably engaged between the link member and the channel. A link control member is connected to the channel and contacts the second contact surface of the link member. The channel is movable from a first operative position in a first direction on arc of 90 degrees or less to a second operative position where the link control member is in contact with the operative portion of the second contact surface of the link. The channel is movable from the second operative position further in the first direction to a break-away position that is more than 90 degrees from the first operative position where the link control member is in contact with the break-away portion of the second contact surface of the link.

20 Claims, 9 Drawing Sheets

SINGLE LINK HINGE ASSEMBLY WITH BREAK-AWAY LINK

BACKGROUND OF THE INVENTION

U.S. Pat. No. 6,453,510, the disclosure of which is hereby expressly incorporated by reference herein, describes a single link hinge assembly. FIGS. 1–4 of the present application illustrate such a single link hinge assembly 10 as described in the U.S. Pat. No. 6,453,510. The hinge assembly 10 includes an elongated channel member 12 preferably defined from a U-shaped member that defines a longitudinally extending recess 14 in a front face. The channel member extends axially between first and second opposite ends 16,18.

A claw member 20 is pivotally connected to the channel 12 adjacent the first end 16 at a pivot point 22 by way of a transverse rivet or other fastener 24. Thus, the channel 12 is adapted for pivoting movement relative to the claw 20 about the pivot point 22 on an arc E in respective first and second opposite directions E1,E2. The channel is movable on the arc E to and between a first operative position (FIGS. 1–3) and a second operative position (FIG. 4). As is generally known in the art, the claw 20 is adapted for connection to an appliance frame or chassis, such as that of an oven or the like, and the channel is adapted for connection to an appliance door, such as an oven door. Thus, the hinge assembly 10 (typically provided in a pair) is adapted for supporting an appliance door relative to the appliance frame so that the door is pivotally movable between a closed position that corresponds to the first operative position of the channel 12, and an open position that corresponds to the second operative position of the channel 12. The transverse rivet 24, or a sleeve, bushing, roller or other member 24' (FIG. 3) held thereby in recess 14, provides a link stop 40*a*, the purpose of which is described in full detail below.

In addition to being interconnected at the pivot point 22, the claw and channel 12 are operably interconnected by a link assembly 30 comprising a single link member 32 and a spring 34. A first end 32*a* of the link member 32 is pivotally connected to a central region of the claw 20 by a rivet 36, and a second end 32*b* of the link member 32 is connected to a first end 34*a* of the spring 34. The second end 34*b* of the spring is fixedly secured to the channel member 12, preferably adjacent the channel member second end 18 or at least at a point axially spaced from the first end 16 of the channel member 12. As shown herein, spring 34 is a coil spring conformed with hooks at both its first and second ends 34*a*,34*b*—the hook at the spring first end 34*a* adapted to engage an aperture 38 or other portion of the link member 32, and the hook at the spring second end 34*b* adapted to engage a projecting portion 19 of the channel second end 18. The link member 32 also defines opposite first and second contact surfaces or edges 42*a*,42*b*, respectively.

The hinge assembly 10 further comprises a link control member 40*b*, preferably provided in the form of a sleeve or roller 25' (FIG. 3) supported on a rivet or other fastener 25 and spanning the recess 14 adjacent the second contact surface 42*b* of the link member 32. The link member 32 is located between the link stop 40*a* and the link control member 40*b*.

As shown in FIG. 1, a first end of the second link contact surface 42*b* defines a projecting lobe 44 that is conformed to engage the link control member 40*b* when the channel 12 is moved to its first operative position. The lobe 44 urges the link control member 40*b* and, thus, the channel member 12, away from the link member 32 to hold the channel member 12 in its first operative position. The second end 46 of the second contact surface 42*b* is conformed to curve smoothly toward the channel member 12. Notably, for reasons described below, no dwell point need be defined in the second end 46 of the surface 42*b*. This allows the link member 32 to be smaller in size.

The spring 34 is preferably a coil spring that normally biases the channel 12 into its first operative position. When the channel is in its first operative position, the spring 34 is relatively but not completely relaxed. Upon movement of the channel 12 in the first direction E1 on the arc E toward the second operative position, the spring 34 elongates and is tensioned. As the spring elongates, the link 32 moves toward the first end 16 of the channel 12, with the link control member 40*b* preferably continuously engaging the second contact surface 42*b* of the link 32 as this movement occurs.

With particular reference to FIG. 4, when the channel 12 is moved fully into its second operative position, the link control member 40*b* is engaged with the second end 46 of the second link contact surface 42*b* which causes the link 32 to be urged away from the channel 12, i.e., outwardly of the channel recess 14. The first contact surface 42*a* of the link 32 engages and is held in engagement with the link stop 40*a*.

Those of ordinary skill in the art will recognize that, owing to the fact that the first and second contact surfaces 42*a*,42*b* of the link member 32 are in respective contact with link stop 40*a* and link control member 40*b* when the channel member 12 is in its second operative position, the channel member 12 is unable to pivot farther in the first direction E1, i.e., engagement of the first and second link contact surfaces 42*a*,42*b* with the stop 40*a* and control member 40*b*, respectively, provides a stop that defines the second operative position of the channel member 12.

When the channel 12 is in its second operative position as shown in FIG. 4, the link 32 is wedged into engagement with the link stop 40*a* and link control member 40*b*, and is also held in position by the fastener 36 that connects the link 32 to the claw 20. With the link 32 so positioned, application of force on the channel member 12 in an effort to move it further in the first direction E1 beyond the second operative position causes the force to be distributed in a triangular pattern between the link stop 40*a*, the link control member 40*b*, and the connection point 36. When the channel 12 is in its second operative position, the link 32 is engaged with and supported by the link stop 40*a*, the control member 40*b*, and the rivet or other fastener 36.

Double link hinge assemblies including various break-away link structures are known and comprise multiple aligned links 32 for added strength. These are more expensive to manufacture as compared to single link hinge assemblies. For this and other reasons, it has been deemed desirable to provide a single-link hinge assembly, such as the hinge assembly 10, with a self-contained "over-open" or break-away mechanism (i.e., one not relying upon external components) that allow the channel member 12 to pivot relative to the claw in the first direction E1 beyond the second operative position described above to a break-away position upon application of sufficient break-away force to the channel member 12 or an appliance door connected thereto for preventing damage to the appliance frame and/or the hinge assembly and to prevent tipping of the appliance.

SUMMARY OF THE INVENTION

In accordance with a first aspect of the invention, a hinge assembly comprises a claw and a channel pivotally connected to the claw at a first pivot point and adapted for movement on an arc in a first direction and in a second direction opposite the first direction. The channel is movable from a first operative position in the first direction to a second operative position, and further in the first direction to a break-away position. A link control member is connected to the channel. A spring has first and second ends, and the second end is operably engaged with the channel. A single link member defines first and second opposite contact surfaces and first and second opposite ends. The first end is pivotally connected to the claw and said second end operably engaged with the first end of the spring. The second contact surface of the link member abuts the link control member and defines: (i) a peak; (ii) an operative surface portion on a first side of the peak that cooperates with the peak to define a first dwell point; and, (iii) a break-away surface portion on a second side of the peak. The link member is movable relative to the link control member in response to pivoting movement of the channel relative to the claw. The link control member is in contact with the operative surface portion of the link when the channel is located in the first operative position; the link control member is located in the first dwell point when the channel is located in the second operative position; and, the link control member is in contact with the break-away surface portion of the link when the channel is located in the break-away position.

In accordance with another aspect of the present invention, an oven comprises a frame, a door, and at least one hinge assembly that movably connects the door to the frame. The at least one hinge assembly comprises a claw connected to the frame, and a channel connected to the door. The channel is also pivotally connected to the claw at a first pivot point and is adapted for movement on an arc in a first direction and in a second direction opposite the first direction. The channel is movable from a first operative position in the first direction to a second operative position, and further in the first direction to a break-away position, wherein: (i) the first operative position corresponds to a fully closed position of the door relative to the frame; (ii) the second operative position corresponds to a fully open operative position of the door relative to the frame; and, (iii) the break-away position corresponds to a non-operative over-open position of the door relative to the frame where the door is non-horizontal. A link control member is connected to the channel. A spring has first and second ends, and the second end operably engaged with the channel. A single link member defines first and second opposite contact surfaces and first and second opposite ends. The first end is pivotally connected to the claw and the second end is operably engaged with the first end of spring. The second contact surface of the link member abuts the link control member and defines: (i) a peak; (ii) an operative surface portion on a first side of the peak that cooperates with the peak to define a first dwell point; and, (iii) a break-away surface portion on a second side of the peak. The link member is movable relative to the link control member in response to pivoting movement of the channel relative to the claw. The link control member is in contact with the operative surface portion of the link when the channel is located in the first operative position; the link control member is located in the first dwell point when the channel is located in the second operative position; and, (iii) the link control member is in contact with the break-away surface portion of the link when the channel is located in the break-away position.

In accordance with a further aspect of the invention, a hinge assembly for connecting an appliance door to an appliance frame is disclosed. The hinge assembly includes a claw and a channel pivotally connected to the claw. A single link member is pivotally connected to the claw, and the link member defines first and second contact surfaces. The second contact surface defines an operative portion and a break-away portion separated from the operative portion by a peak that projects outwardly from the second contact surface. A spring is operably engaged between the link member and the channel. A link control member is connected to the channel and contacts the second contact surface of the link member. The channel is movable from a first operative position in a first direction on arc of 90 degrees or less to a second operative position where said link control member is in contact with the operative portion of the second contact surface of the link. The channel is movable from the second operative position further in the first direction to a break-away position that is more than 90 degrees from said first operative position where the link control member is in contact with the break-away portion of the second contact surface of the link.

BRIEF DESCRIPTION OF THE DRAWINGS

The invention comprises a variety of components and arrangements of components, preferred embodiments of which are illustrated in the accompanying drawings that form a part hereof and wherein.

DETAILED DESCRIPTION OF THE PREFERRED EMBODIMENT

Figure 1:
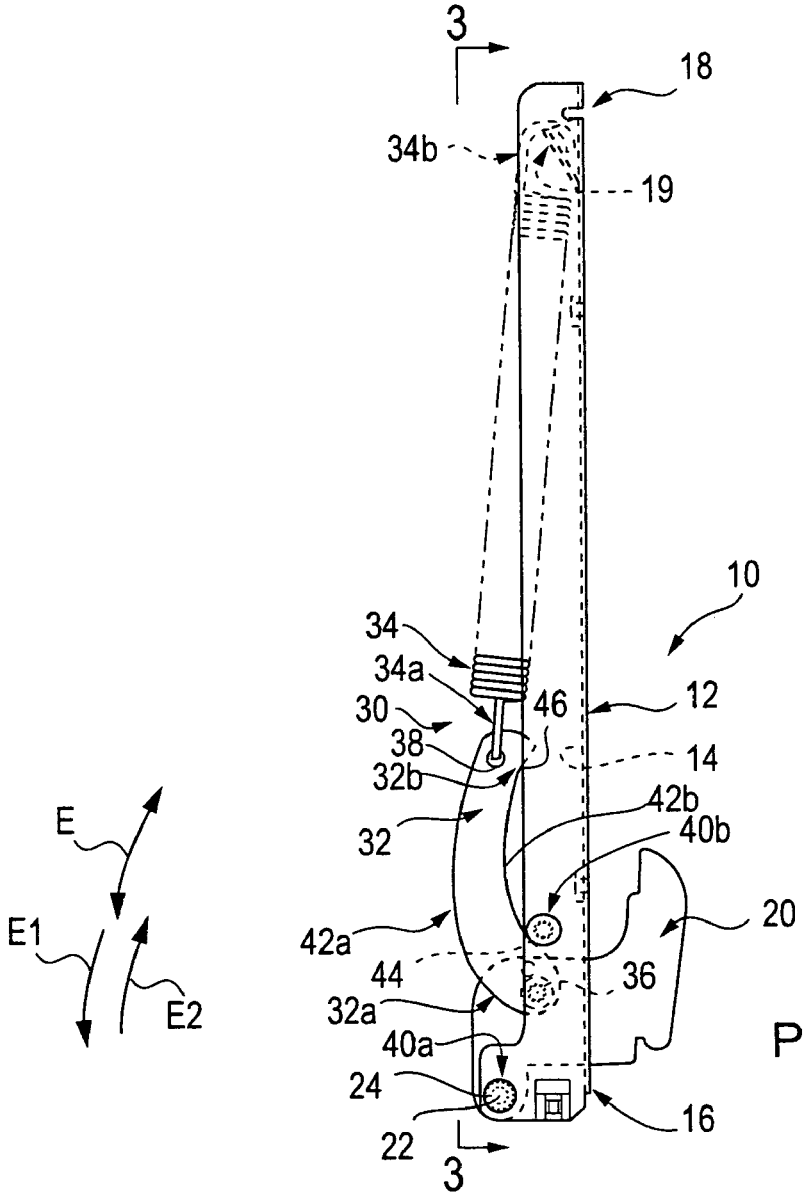
FIG. 1 PRIOR ART
FIG. 1 (prior art) is a side elevational view of a single-link hinge assembly in a first operative position.
Figure 2:
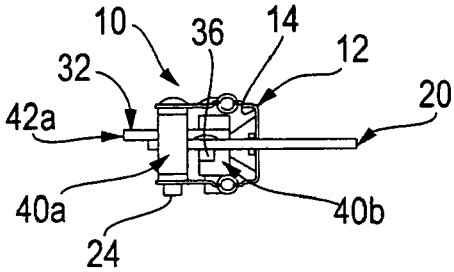
FIG. 2 PRIOR ART
FIG. 2 (prior art) is a bottom view of the hinge assembly shown in FIG. 1.
Figure 3:
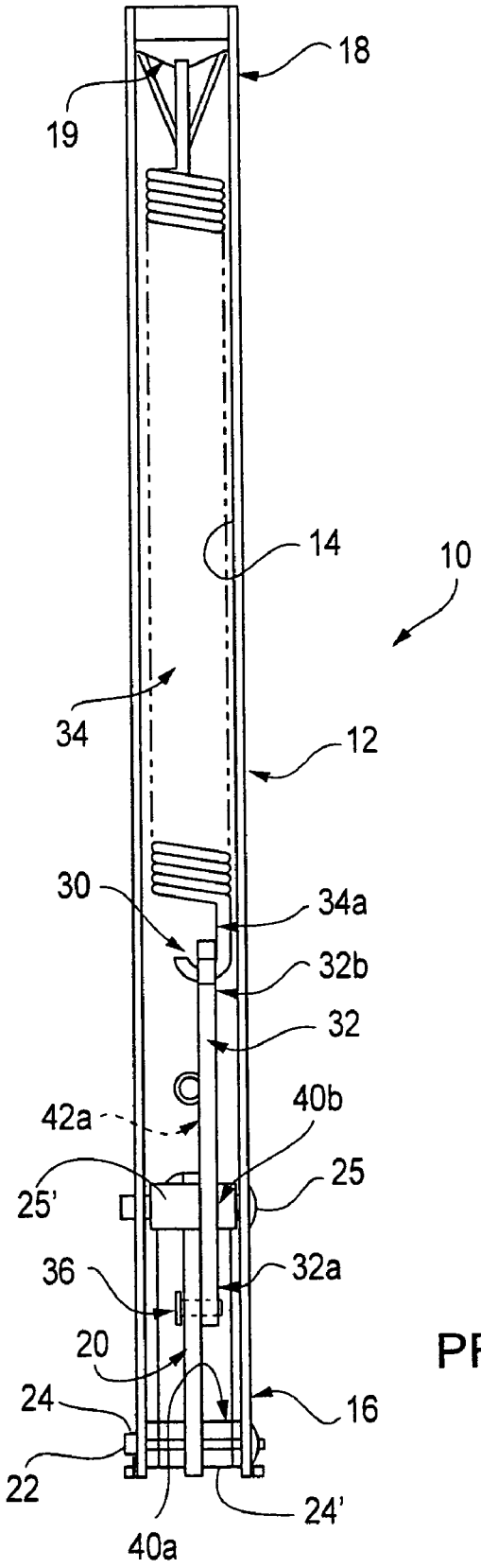
FIG. 3 PRIOR ART
FIG. 3 (prior art) is a front elevational view of the hinge assembly shown in FIG. 1 as taken along view line 3—3.
Figure 4:
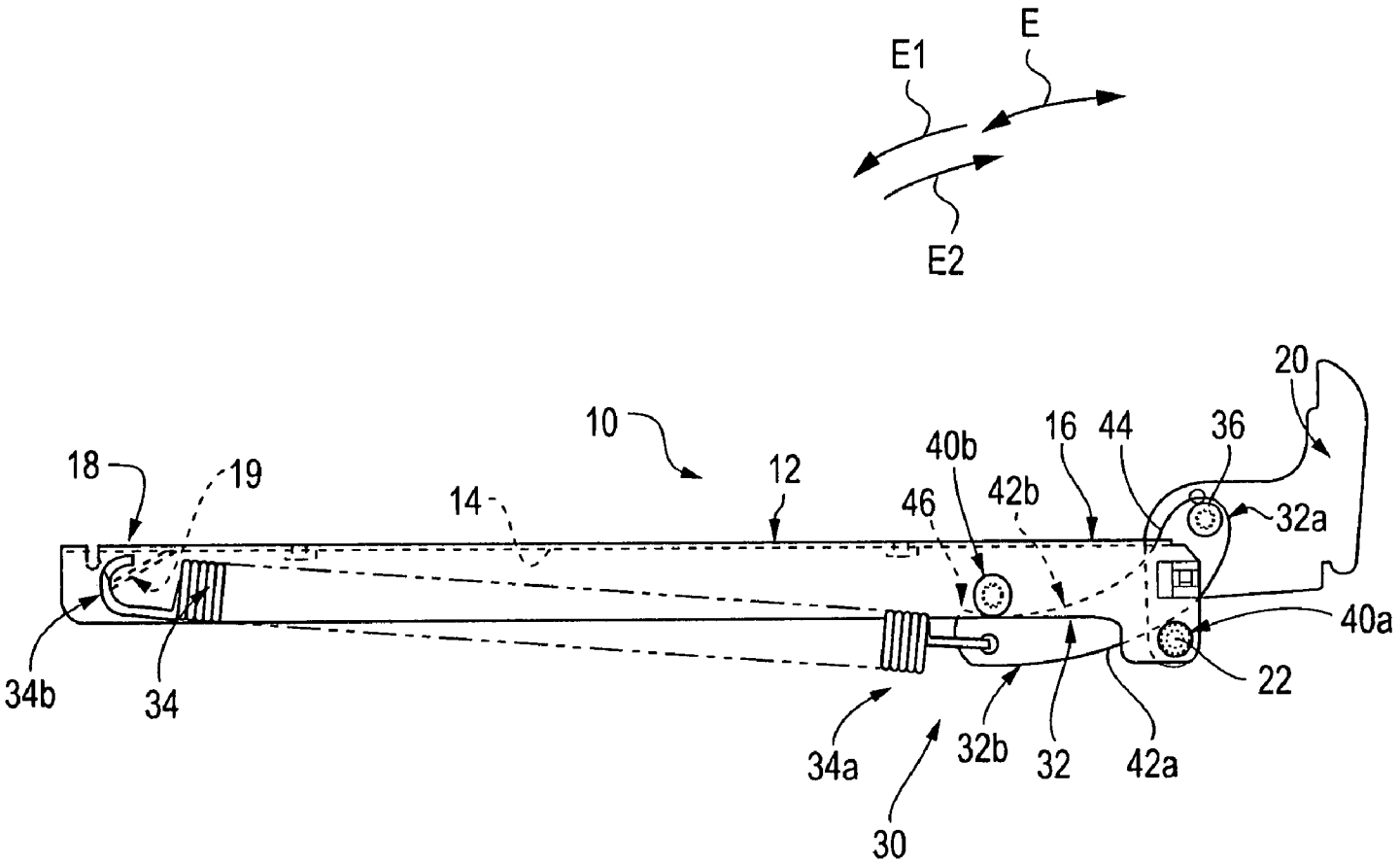
FIG. 4 PRIOR ART
FIG. 4 (prior art) is a side elevational view of the hinge assembly shown in FIG. 1 in a second operative position.
Figure 5:
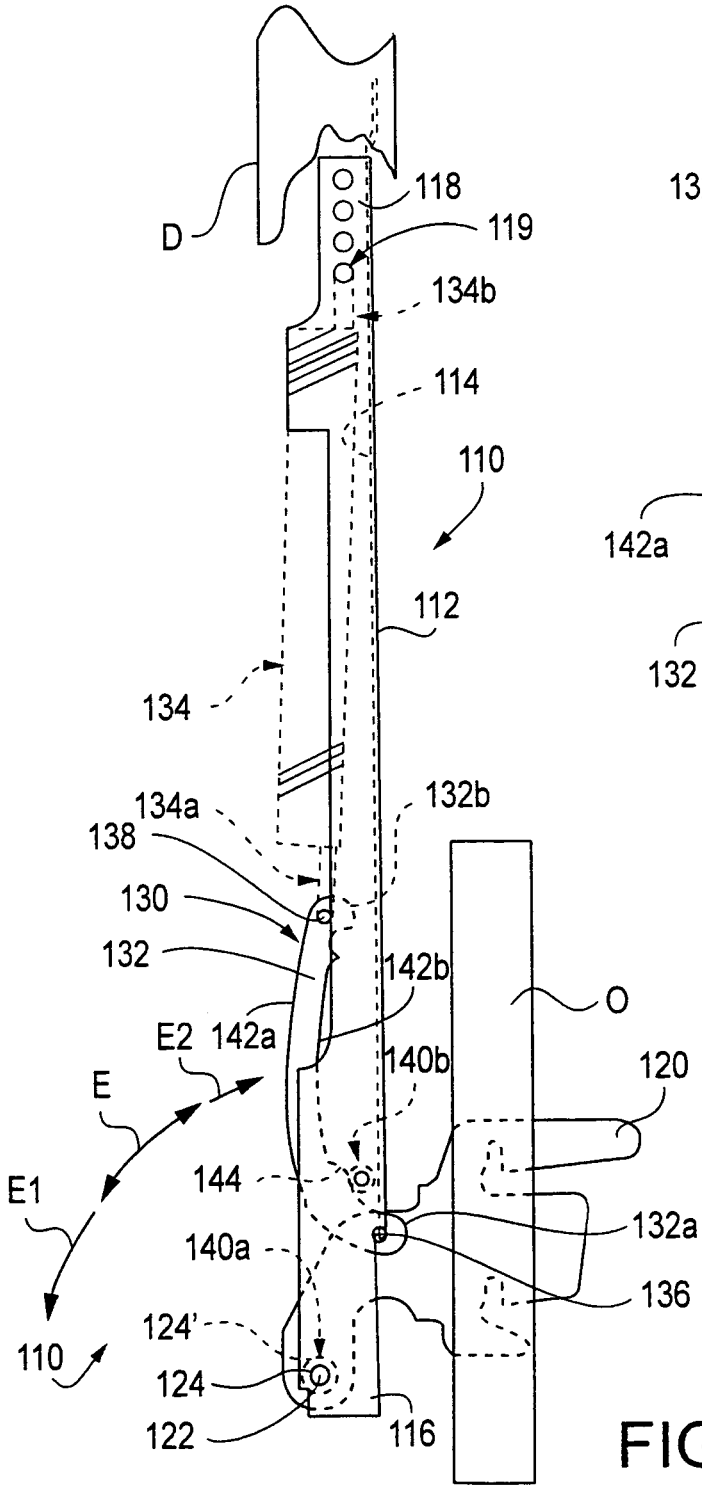
FIG. 5 is a side elevational view of a break away hinge assembly with break-away link formed in accordance with the present invention in a first operative position.

FIG. 5 shows a hinge assembly 110 formed in accordance with the present invention operatively connected a frame or chassis O of an oven or other appliance. More particularly, the hinge assembly 110 comprises an elongated channel member 112 preferably defined from a U-shaped member that defines a longitudinally extending recess 114 in a front face. The channel member 112 extends axially between first and second opposite ends 116,118.

A claw member 120 is pivotally connected to the channel 112 adjacent the first end 116 at a pivot point 122 by way of a transverse rivet or other fastener 124, and the fastener 124 supports a coaxial sleeve, bushing, roller or the like 124' that at least partially transversely spans the recess 114 of channel 112. In this way, the channel 112 is adapted for pivoting movement relative to the claw 120 about the pivot point 122 on an arc E in respective first and second opposite directions E1,E2.

Figure 5A:
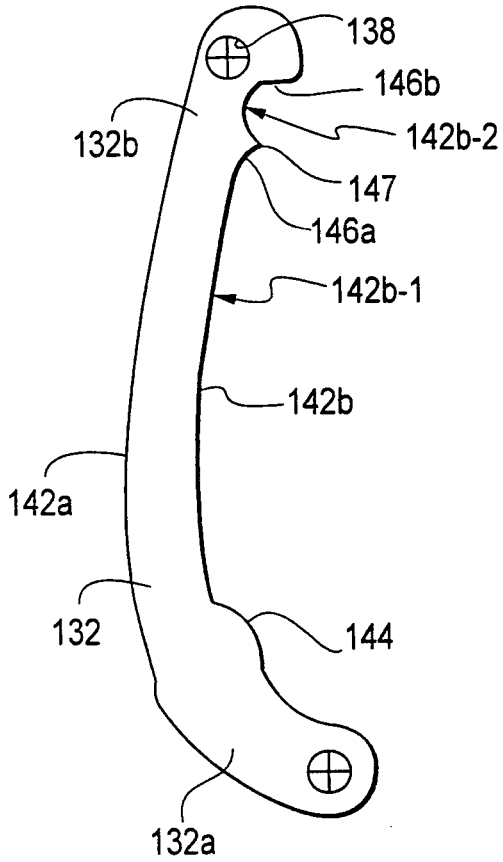
FIG. 5A is an enlarged side elevational view of the break-away link portion of the hinge assembly shown in FIG. 5.
Figure 5B:
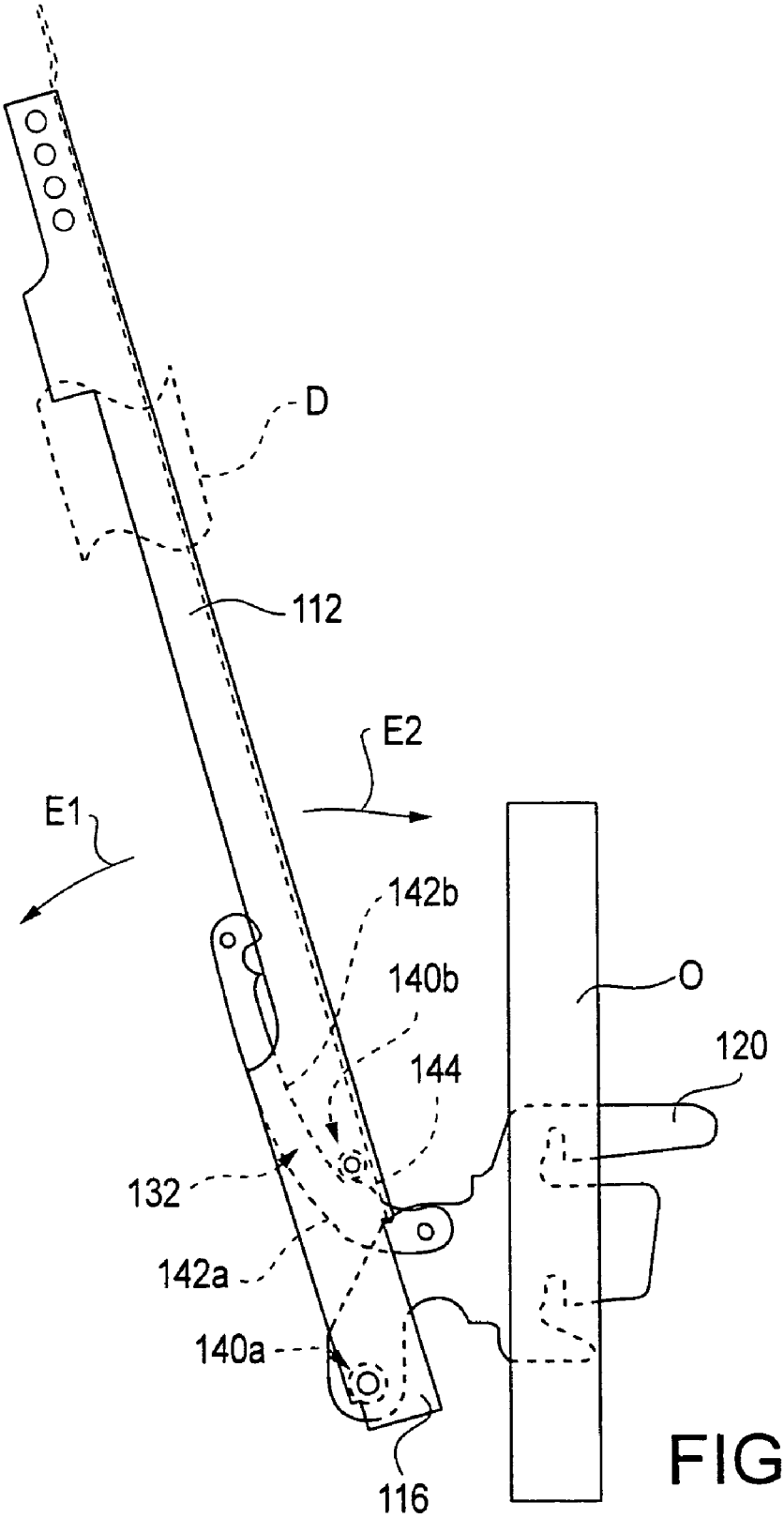
FIGS. 5B–5D are side elevational views of the hinge assembly of FIG. 5 (without showing the spring) in broil, second and break-away operative positions, respectively.
Figure 5C:
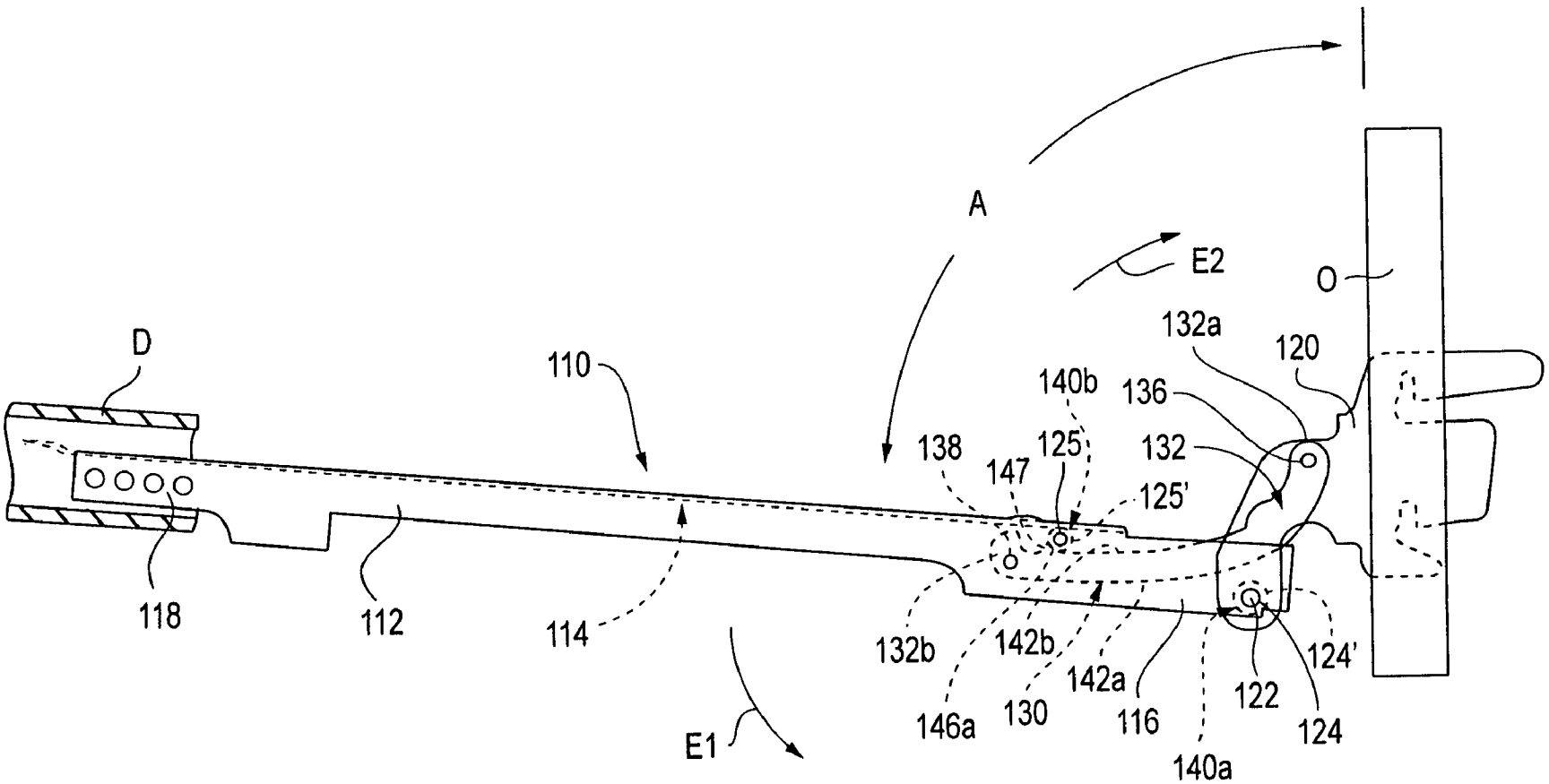

The channel 112 is movable on the arc E to and between a first operative position as shown in FIG. 5 and a second operative position shown in FIG. 5C. As is generally known in the art, the claw 120 is adapted for connection to an appliance frame or chassis O, such as that of an oven or the like, and the channel 112 is adapted for connection to an appliance door D (FIG. 5), such as an oven door. The hinge assembly 110 (typically provided in a pair) is adapted for supporting an appliance door D relative to the appliance chassis O so that the door is pivotally movable between a closed position that corresponds to the first operative position of the channel 112 (FIG. 5), and an open position (for access to a cooking chamber or other space) that corresponds to the second operative position of the channel 112 (FIG. 5C). The transverse rivet 124, in combination with the sleeve 124', preferably defines a link stop 140*a*, the purpose of which is described in full detail below.

In addition to being interconnected at the pivot point 122 by fastener 124, the claw 120 and channel 112 are operably interconnected by a link assembly 130 that comprises a single link member 132 and a spring 134. A first end 132*a* of the link member 132 is pivotally connected to a central region of the claw 120 by a rivet or other fastener 136, and a second end 132*b* of the link member 132 is connected to a first end 134*a* of the spring 134. The second end 134*b* of the spring is fixedly secured to the channel member 112, preferably adjacent the channel member second end 118 (or at least at a point axially spaced from the channel first end 116). As shown herein, it is most preferred that, in order to minimize the use of fasteners such as rivets, the spring 134 be a coil spring conformed with hooks at both its first and second ends 134*a*,134*b*; the hook at the first end 134*a* is adapted to engage an aperture 138 or other portion of the link member 132, and the hook at the second end 134*b* is adapted to engage a portion 119 of the channel second end 118 or a structure connected thereto. The link member 132 also defines opposite first and second contact surfaces or edges 142*a*,142*b*, respectively.

The hinge assembly 110 further comprises a link control member 140*b* connected to the channel 112 and located in recess 114. The link control member 140*b* is preferably defined by a rivet or other fastener 125 connected to the channel 112 and spanning recess 114, and including a sleeve, bushing, roller or the like 125' coaxially supported thereon and extending transversely at least partially across recess 114. The link control member 140*b* is spaced axially from the link stop 140*a* and is located adjacent the second contact surface 142*b* of the link member 132. As such, the link member 132 is located between the stop 140*a* and the control member 140*b*, with the first link contact surface 142*a* oriented toward the stop 140*a* and the second link contact surface 142*b* oriented toward the control member 140*b*.

The second link contact surface 142*b* defines a projecting lobe 144 that is conformed to engage link control member 140*b* when the channel 112 is in its first operative position. The lobe 144 urges the link control member 140*b* and, thus, the channel member 112, away from the link member 132 so as to hold the channel member 112 in its first operative position with greater "pull-in" force. The lobe 144 also cooperates with the link control member 140*b* so that the channel member 112 (including a door D connected thereto) counter-balances in an intermediate "broil-stop" position as shown in FIG. 5B when channel member 112 is moved manually to this position on the arc E.

With reference also to FIG. 5A where the link 132 is shown by itself, the second link contact surface 142*b* preferably also comprises a cusp or peak 147 projecting outwardly therefrom that divides the second contact surface 142*b* into an operative portion 142*b*-1 and a break-away portion 142*b*-2. A first dwell point 146*a* is defined at the intersection of the peak 147 and the operative surface portion 142*b*-1 and is preferably defined by a radiused surface that is dimensioned to mate with the link control member 140*b*. The first dwell point 146*a* is adapted to receive and retain the link control member 140*b* therein when the channel 112 is pivoted to its second operative position as shown in FIG. 5C. In the embodiment illustrated in FIGS. 5 and 5A–5D, the break-away surface portion 142*b*-2 cooperates with peak 147 to define a second dwell point 146*b* that comprises a cylindrical recess dimensioned to receive link control member 140*b* when break-away surface portion 142*b*-2 moves adjacent link control member 140*b* (FIG. 5C).

The spring 134 is preferably a coil spring that normally biases the channel 112 into its first operative position (FIG. 5). When the channel 112 is located in its first operative position, the spring 134 is relatively shortened and partially relaxed. Upon movement of the channel 112 in the first direction E1 on the arc E toward the second operative position (FIG. 5C), the spring 134 elongates and is tensioned as the claw 120 pulls the link 132 downward toward channel first end 116. As the link 132 moves toward the first end 116 of the channel 112 against the biasing force of the spring, the second contact surface 142*b* of the link 132 rides on link control member 140*b* which preferably comprises a roller to facilitate this action.

Figure 5D:
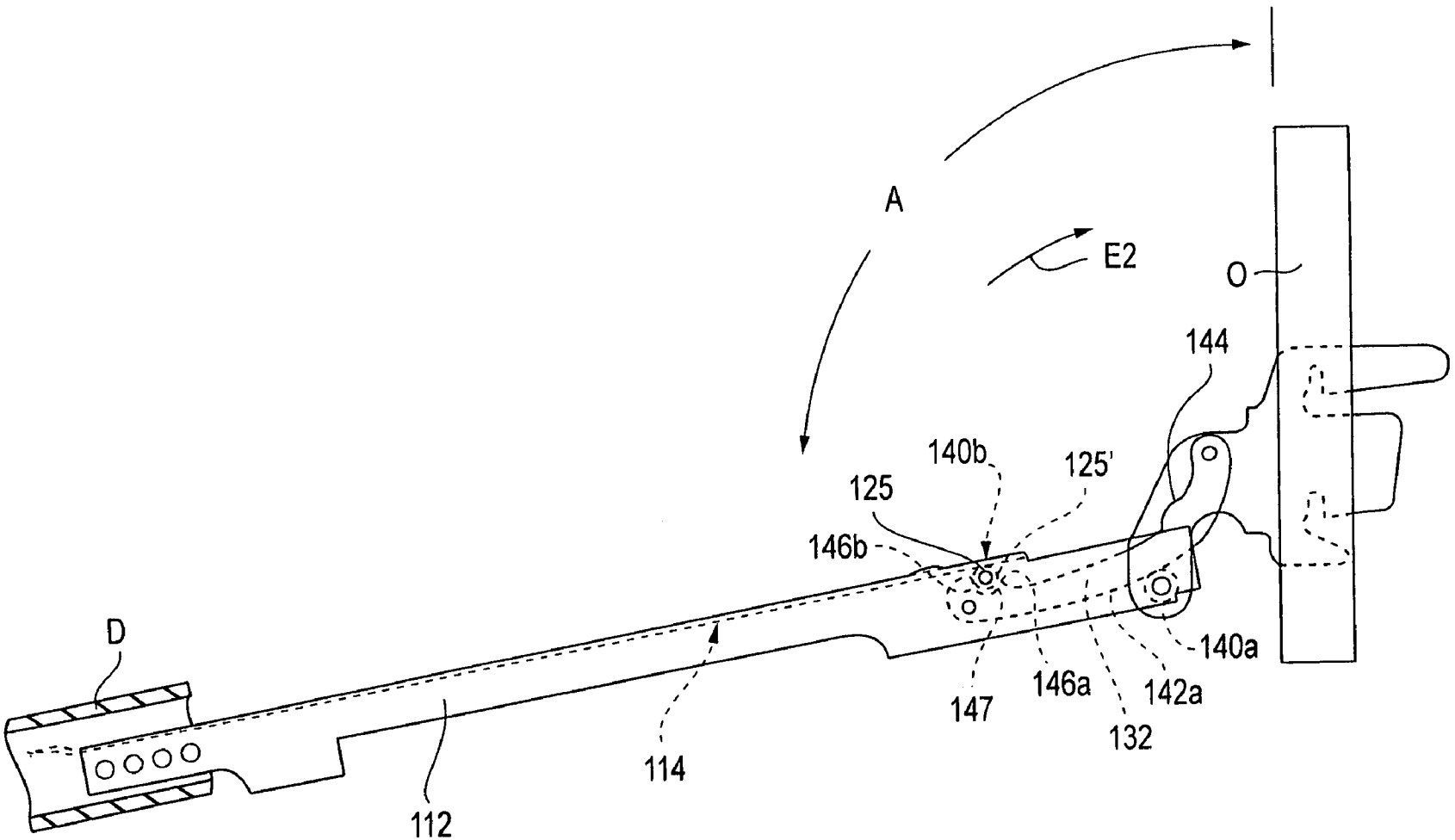

With particular reference to FIG. 5C, when the channel 112 is moved fully into its second operative position, the link control member 140*b* seats in the first dwell point 146*a*. Under normal/intended operation, the channel 112 is never pivoted in the first direction E1 beyond the second operative position as shown in FIG. 5C, and the weight of door D in combination with the shape of link 132 and its relationship with link control member 140*b* and spring 134 ensures that the channel 112 and door D counter-balance in the second operative position. Peak 147 ensures that link 132 is resistant to further movement toward channel first end 116 relative to link control member 140*b* that would cause peak 147 to move past link control member 140*b* so that break-away surface portion 142*b*-2 contacts the link control member 140*b*. If, however, sufficient excessive break-away force is applied to channel 112 (or door D to which it is connected) in the direction E1 such as, e.g., a person placing his/her full or partial weight on the door D, link 132 will move further toward channel first end 116 relative to link control member 140*b* so that peak 147 of link 132 moves past link control member 140*b* and so that the channel 112 is allowed to pivot further in the first direction E1 to a break-away or "over-open" position (FIG. 5D) (spring 134 elongates further to accommodate the movement). In this break-away position as shown in FIG. 5D, the link control member 140*b* seats in second dwell point 146*b*. The exact angle of the channel member 112 relative to the appliance chassis O in the break-away position can vary, but it is deemed desirable to define the break-away position such that the door D connected to the channel member 112 is sloped (moved past horizontal) to a position where a child or other unsafe load (e.g., a turkey) slides off of the door D.

When the channel member 112 is located in the second operative position, an angle A (FIG. 5C) of no more the 90 degrees is defined between the channel member 112 and a vertical portion of the appliance frame O to which the hinge assembly 110 is connected, i.e., the channel member 112 does not move past horizontal. As shown in FIG. 5D, however, in break-away position, the channel member 112 has moved beyond a horizontal state so that it defines an angle A with the vertical member of the appliance frame O that is greater than 90 degrees. Stated another way, the channel 112 moves no more than 90 degrees from its first operative position to its second operative position, and is moved more than 90 degrees from its first operative position to the break-away (over-open) position. By allowing the channel member 112 to pivot beyond the second operative position (FIG. 5C) to the break-away position as described, damage to the hinge assembly 110 or appliance chassis or frame O is prevented, and tipping of the appliance is also prevented. The first contact surface 142*a* of link 132 abuts link stop 140*a* when the channel 112 is pivoted to the break-away position as shown in FIG. 5D. This abutment of first link contact surface 142*a* with stop 140*a* prevents pivoting movement of channel 112 in the first direction E1 beyond the break-away position and also prevents movement of link 132 outwardly of recess 114. Also, when first link contact surface 142*a* engages stop 140*a*, the stop supports link 132 and prevents deformation of same and/or damage to the link control member 140*b*.

In the illustrated embodiment, once the channel 112 moves into the break-away position as shown in FIG. 5D, the force of spring 134 alone is insufficient to overcome the weight of the door and engagement of the link control member 140*b* with second dwell point 146*b* so as to return the channel 112 and link 132 to the second operative position. Instead, the hinge assembly 110 must be manually re-set by application of force to channel 112 (or door D to which channel is connected) in the second direction E2 opposite the first direction so that link 132 will move away from first channel end 116, with peak 147 moving over link control member 140*b*, so that the link control member 140*b* is once again moved into the first dwell point 146*a* or further onto the operative surface portion 142*b*-1. Whether or not the hinge assembly 110 must be manually re-set after the channel 112 is moved into the break-away position can be controlled by the shape of the link 132 as described below. In certain applications, it has been deemed desirable to shape the link 132 such that an end-user can never manually re-set the hinge assembly 110 and must call a service technician. This can be accomplished by forming the link 132 so that, once the link control member 140*b* moves over the peak 147, simple application of force on the channel member 112 in the opposite direction E2 is not sufficient to accomplish the re-set operation. This can be accomplished by forming the peak 147 with an undercut or the like.

The select force required to move the channel 112 from the second operative position to the break-away position can vary depending upon the force of spring 134 and the profile of the link 132.

Figures 6, 6A:
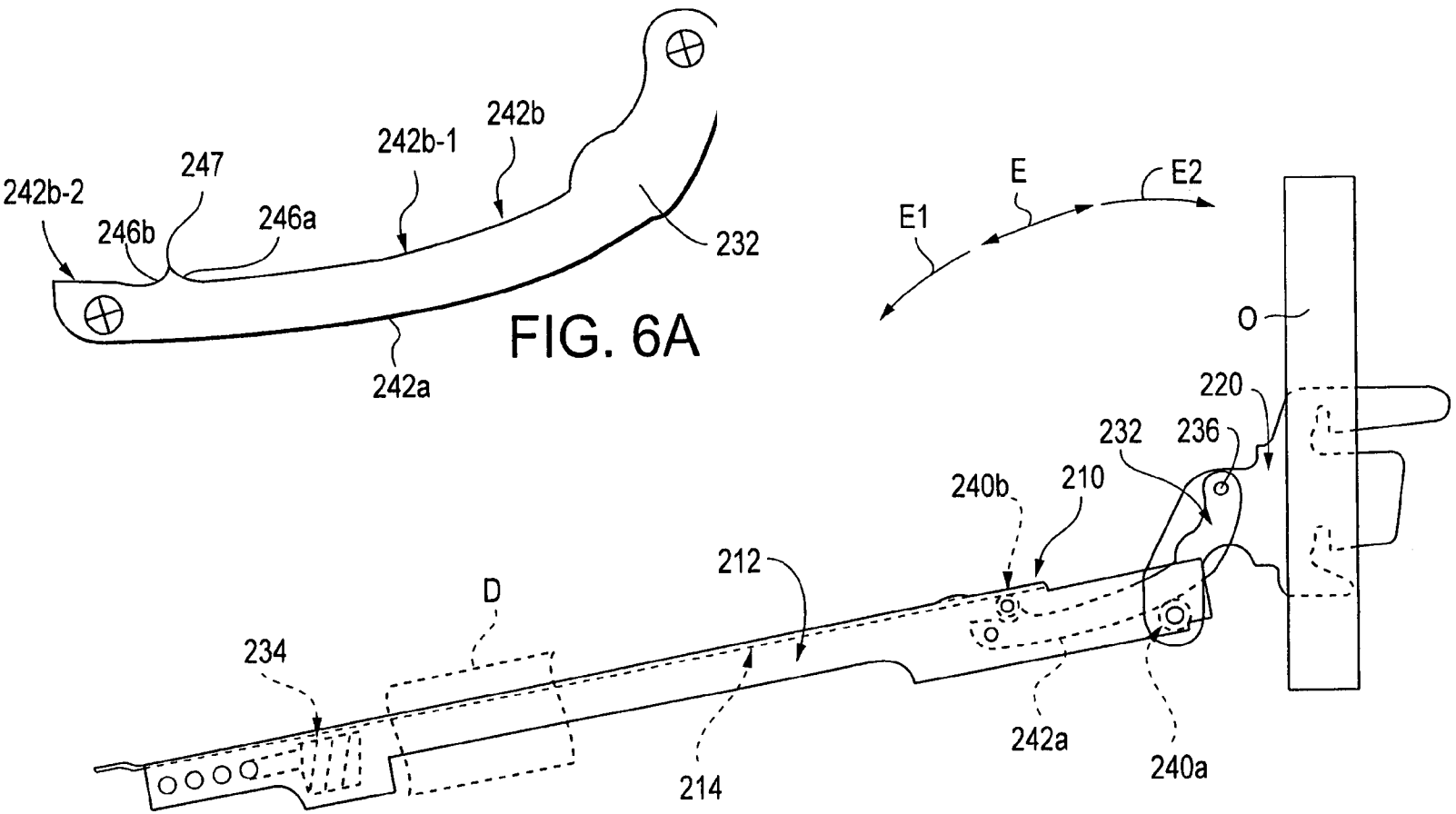
FIG. 6 illustrates a single link hinge assembly with break-away link formed in accordance with an alternative embodiment of the present invention.
FIG. 6A is an enlarged side elevational view of the break-away link portion of the hinge assembly shown in FIG. 6.

The link 132 can be formed alternatively as described below in relation to FIGS. 6, 6A, 7 and 7A. Except as otherwise shown and/or described, the hinge assembly 210 shown in FIG. 6 is identical to the hinge assembly 110 described above (spring 234 is shown on partially for clarity). As such, like components of the hinge assembly 210 relative to the hinge assembly 110 are identified with like reference numbers that are one-hundred greater than those used in relation to the hinge assembly 110. The only difference between the hinge assembly 210 and the hinge assembly 110 is that the hinge assembly 210 comprises and alternative link member 232.

The alternative link member 232 is shown separately in FIG. 6A. There, it can be seen that the break-away surface portion 242*b*-2 is flat and blends into peak 247 so that peak 247 and break-away surface portion 242*b*-2 cooperate to define the second dwell point 246*b*. The presence of peak 247 that extends outwardly from and separates first and second dwell points 246*a*,246*b* still requires that the hinge assembly 210 be manually re-set (as described above in relation to the hinge assembly 110) after the link 232 moves into the break-away position where link control member 240*b* seats in the second dwell point 246*b* (FIG. 6). The re-set operation is performed by manually moving channel 212 via door D pivotally in the second direction E2 opposite the first direction E1. As shown in FIG. 6, the channel member 212 is unable to pivot in the first direction E1 beyond the break-away position owing to the abutment of the first link contact surface 242*a* with the stop 240*a* while the link control member 240*b* is seated in the second dwell point 246*b*.

Figures 7, 7A:
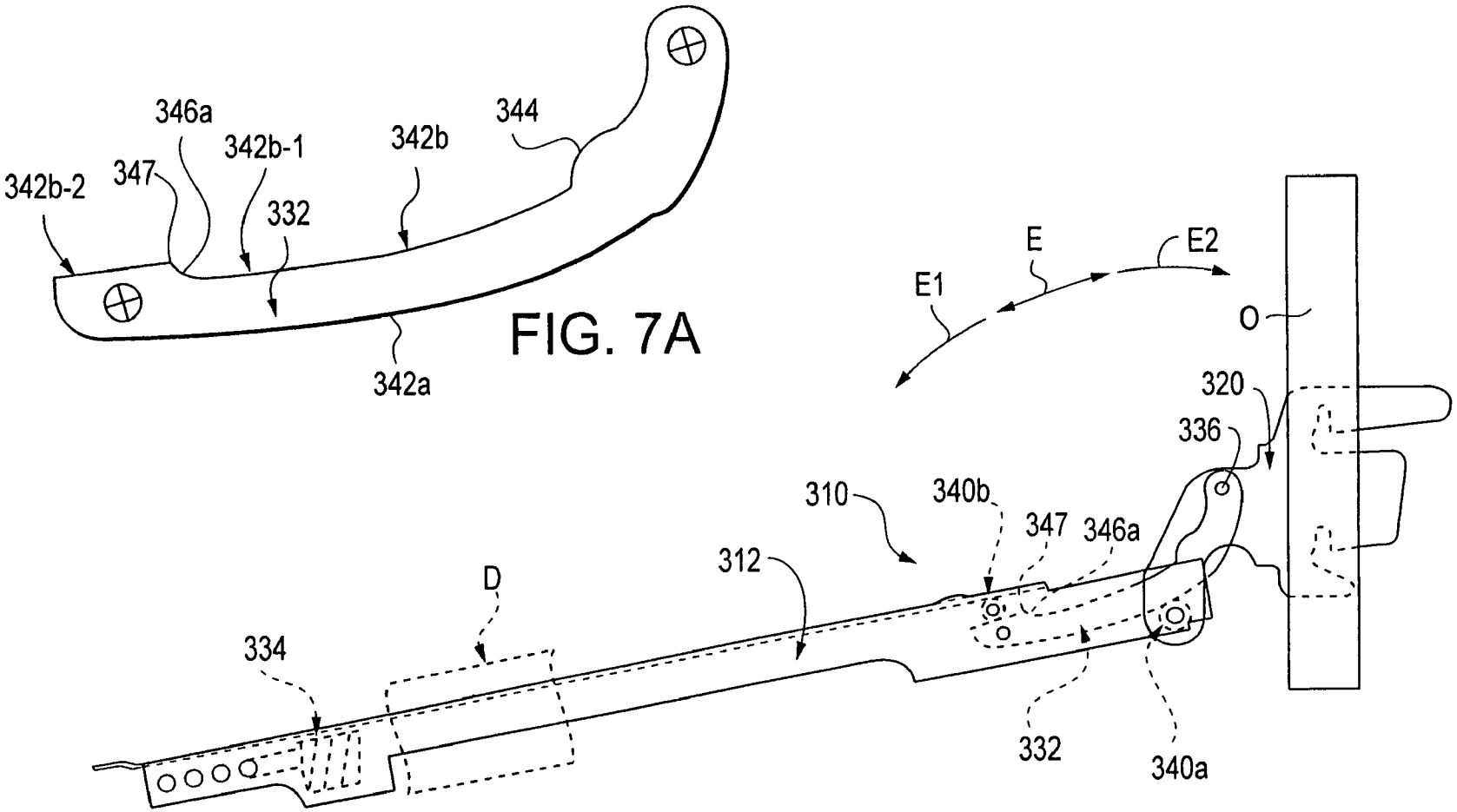
FIG. 7 illustrates a single link hinge assembly with break-away link formed in accordance with another alternative embodiment of the present invention; and, FIG. 7A is an enlarged side elevational view of the break-away link portion of the hinge assembly shown in FIG. 7.

Referring now to FIGS. 7 and 7A, another alternative hinge assembly 310 is shown. Here, again, except as otherwise shown and/or described, the hinge assembly 310 is identical to the hinge assembly 110 described above (spring 334 is shown only partially for clarity). As such, like components of the hinge assembly 310 relative to the hinge assembly 110 are identified with like reference numbers that are two-hundred greater than those used in relation to the hinge assembly 110. The only difference between the hinge assembly 310 and the hinge assembly 110 is that the hinge assembly 310 comprises and alternative link member 332. The link member 332 is shown separately in FIG. 7A. There, it can be seen that the break-away surface portion 342*b*-2 is flat and blends directly into the first dwell point 346*a*, i.e., the break-away surface 342*b*-2 is flat and defines one face of peak 347. As such, when the hinge assembly 310 is manipulated into the break-away position as shown in FIG. 7, the link control member 340*b* lies in contact with the flat break-away surface 342*b*-2. Upon removal or lessening of the break-away force being applied to channel 312 or door D connected to channel 312, the spring 334 urges channel 312 in the second direction E2 until link 332 moves relative to link control member 340*b* away from the channel first end 316 sufficiently for the link control member 340*b* to seat in first dwell point 346*a* defined at the intersection of operative surface 342*b*-1 with peak 347. Hinge assembly 310 automatically re-sets under biasing force of spring 334 from the break-away position to the second operative position upon reduction or removal of the break-away force that caused the hinge assembly 310 to move into the break-away position.

As noted, it is preferred that the link member 132,232,332 abut link stop 140*a*,240*a*,340*a* when the channel member 112,212,312 is moved into the break-away position as shown in FIGS. 5D, 6 and 7, respectively, to prevent further pivoting of channel member 112,212,312 in first direction E1. This structure is also important in that it allows the single link member 132,232,332 to resist deformation when the channel 112,212,312 is moved into the break-away position, i.e., a group of two or more link members 132, 232,332 is not required for added strength and thickness of links 132,232,332 can be reduced. When the channel 112,

212,312 is moved fully to the break-away position, the link 132,232,332 is wedged between the stop 140*a*,240*a*,340*a* and link control member 140*b*,240*b*,340*b*. The link 132,232,332 is also held in position by the rivet or other fastener 136,236,336 that connects the link to the claw 120,220,320. As such, application of force on the channel member 112,212,312 in an effort to move it further in the first direction E1 beyond the break-away position causes this force to be distributed in a triangular pattern between the stop 140*a*, 240*a*,340*a*, link control member 140*b*,240*b*,340*b*, and claw connection fastener 136,236,336.

The invention has been described with reference to preferred embodiments. Of course, modifications and alterations will occur to others upon a reading and understanding of the preceding specification. It is intended that the invention be construed as including all such modifications and alterations.

What is claimed is:

1. A hinge assembly comprising:

a claw;

a channel pivotally connected to the claw at a first pivot point and adapted for movement on an arc in a first direction and in a second direction opposite said first direction, said channel movable from a first operative position in said first direction to a second operative position, and further in said first direction to a break-away position;

a link control member connected to said channel;

a spring having first and second ends, said second end operably engaged with said channel;

a single link member defining first and second opposite contact surfaces and first and second opposite ends, said first end pivotally connected to said claw and said second end operably engaged with said first end of the spring, said second contact surface of said link member abutting said link control member and defining: (i) a peak; (ii) an operative surface portion on a first side of said peak that cooperates with said peak to define a first dwell point; and, (iii) a break-away surface portion on a second side of said peak, wherein said link member is movable relative to said link control member in response to pivoting movement of said channel relative to said claw, and wherein: (i) said link control member is in contact with said operative surface portion of said link when said channel is located in said first operative position; (ii) said link control member is located in said first dwell point when said channel is located in said second operative position; and, (iii) said link control member is in contact with said break-away surface portion of said link when said channel is located in said break-away position.

2. The hinge assembly as set forth in claim 1, wherein said peak of said link engages said link control member to inhibit movement of said link and said channel when said channel moves from said second operative position to said break-away position.

3. The hinge assembly as set forth in claim 1, wherein said break-away surface portion of said link comprises a second dwell point in which said link control member is seated when said channel is located in said break-away position.

4. The hinge assembly as set forth in claim 3, wherein said second dwell point is defined by cooperating portions of said break-away surface portion and said peak.

5. The hinge assembly as set forth in claim 1, wherein said first dwell point is partially defined by a first face of said peak, and wherein said break-away surface portion is flat and defines a second face of said peak.

6. The hinge assembly as set forth in claim 1, wherein said second contact surface of said link further comprises a projecting lobe spaced from said first dwell point, said projecting lobe contacting said link control member when said channel is located in said first operative position.

7. The hinge assembly as set forth in claim 6, wherein said channel member is movable to an intermediate broil-stop position between said first operative position and said second operative position, said projecting lobe contacting said link control member when said channel member is located in said intermediate broil-stop position.

8. The hinge assembly as set forth in claim 1, further comprising a link stop connected to said channel, wherein said link contacts said link stop when said channel is located in said break-away position to prevent movement of said channel in said first direction beyond said break-away position.

9. The hinge assembly as set forth in claim 8, wherein said link is located between and engaged with both said link stop and said link control member when said channel is located in said break-away position.

10. The hinge assembly as set forth in claim 8, wherein said channel is pivotally connected to said claw at said first pivot point by a fastener, and wherein said link stop is at least partially defined by said fastener.

11. The hinge assembly as set forth in claim 10, wherein said fastener comprises a rivet, and wherein said link stop comprises said rivet and a member coaxially mounted on said rivet.

12. An oven comprising:

a frame;

a door;

at least one hinge assembly that movably connects said door to said frame, said at least one hinge assembly comprising:

a claw connected to said frame;

a channel connected to said door and pivotally connected to the claw at a first pivot point and adapted for movement on an arc in a first direction and in a second direction opposite said first direction, said channel movable from a first operative position in said first direction to a second operative position, and further in said first direction to a break-away position, wherein: (i) said first operative position corresponds to a fully closed position of said door relative to said frame; (ii) said second operative position corresponds to a fully open operative position of said door relative to said frame; and, (iii) said break-away position corresponds to a non-operative over-open position of said door relative to said frame where said door is non-horizontal;

link control member connected to said channel;

a spring having first and second ends, said second end operably engaged with said channel;

a single link member defining first and second opposite contact surfaces and first and second opposite ends, said first end pivotally connected to said claw and said second end operably engaged with said first end of spring, said second contact surface of said link member abutting said link control member and defining: (i) a peak; (ii) an operative surface portion on a first side of said peak that cooperates with said peak to define a first dwell point; and, (iii) a break-away surface portion on a second side of said peak, wherein said link member is movable relative to said link control member in response to pivoting movement of said channel relative to said claw, and wherein: (i) said link control member is in contact with said operative surface portion of said link when said channel is located in said first operative position; (ii) said link control member is located in said first dwell point when said channel is located in said second operative position; and, (iii) said link control member is in contact with said break-away surface portion of said link when said channel is located in said break-away position.

13. The oven as set forth in claim 12, wherein an angle of 90 degrees or less is defined between said first and second operative positions of said channel member, and wherein an angle of greater than 90 degrees is defined between said first operative position and said break-away position.

14. The oven as set forth in claim 12, wherein said break-away surface portion of said link comprises a second dwell point in which said link control member is seated when said channel is located in said break-away position.

15. The oven as set forth in claim 12, wherein said second dwell point is defined by cooperating portions of said break-away surface portion and said peak.

16. The oven as set forth in claim 12, wherein said hinge assembly further comprises a link stop connected to said channel, wherein said link contacts said link stop when said channel is located in said break-away position to prevent movement of said channel in said first direction beyond said break-away position.

17. The oven as set forth in claim 16, wherein said link is located between and engaged with both said link stop and said link control member when said channel is located in said break-away position.

18. A hinge assembly for connecting an appliance door to an appliance frame, said hinge assembly comprising:

a claw;

a channel pivotally connected to said claw;

a single link member pivotally connected to said claw, said link member defining first and second contact surfaces, wherein said second contact surface defines an operative portion and a break-away portion separated from said operative portion by a peak that projects outwardly from said second contact surface;

a spring operably engaged between said link member and said channel; and, a link control member connected to said channel and contacting said second contact surface of said link member, wherein said channel is movable from a first operative position in a first direction on arc of 90 degrees or less to a second operative position where said link control member is in contact with said operative portion of said second contact surface of said link, and wherein said channel is movable from said second operative position further in said first direction to a break-away position that is more than 90 degrees from said first operative position where said link control member is in contact with said break-away portion of said second contact surface of said link.

19. The hinge assembly as set forth in claim 18, wherein said hinge assembly further comprises a link stop connected to said channel and located coaxially with an axis about which said channel pivots relative to said claw, wherein said first contact surface of said link contacts said link stop when said channel is located in said break-away position.

20. The hinge assembly as set forth in claim 19, wherein said link is located between and engaged with both said link stop and said link control member when said channel is located in said break-away position.

* * * * *